US006247859B1

(12) United States Patent
Butcher

(10) Patent No.: US 6,247,859 B1
(45) **Date of Patent: *Jun. 19, 2001**

(54) METHOD OF PRINTING IN WHICH THE PRINT HEAD AND PRINT RIBBON MOVE SIMULTANEOUSLY IN THE SAME DIRECTION

(75) Inventor: James Christopher Butcher, Bottesford (GB)

(73) Assignee: Markem Technologies Limited, Nottingham (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/952,925

(22) PCT Filed: Mar. 18, 1997

(86) PCT No.: PCT/GB97/00738

§ 371 Date: Mar. 20, 1998

§ 102(e) Date: Mar. 20, 1998

(87) PCT Pub. No.: WO97/36751

PCT Pub. Date: Oct. 9, 1997

(30) Foreign Application Priority Data

Mar. 29, 1996 (GB) ..... 9606647

(51) Int. Cl.[7] ..... B41J 33/14
(52) U.S. Cl. ..... 400/120.01; 400/232
(58) Field of Search ..... 400/29, 30, 88, 400/24, 27, 28, 120.01, 232

(56) References Cited

U.S. PATENT DOCUMENTS

| | | | | |
|---|---|---|---|---|
| 4,558,963 | | 12/1985 | Applegate et al. | 400/120 |
| 5,017,028 | * | 5/1991 | Harding | 400/48 |
| 5,033,888 | | 7/1991 | Okumura et al. | 400/248 |
| 5,112,149 | * | 5/1992 | Suenaga | 400/88 |
| 5,372,439 | | 12/1994 | Poole et al. | 400/232 |
| 5,649,774 | * | 7/1997 | Harding et al. | 400/225 |

FOREIGN PATENT DOCUMENTS

| | | | | |
|---|---|---|---|---|
| 3608360 A1 | | 9/1987 | (DE) . | |
| 138444 | * | 4/1985 | (EP) | 400/29 |
| 0 683 055 A2 | | 11/1995 | (EP) . | |
| 2065563 | | 12/1979 | (GB) . | |
| 2289441 | | 11/1995 | (GB) . | |
| 60-240470 | * | 11/1985 | (JP) | 400/29 |
| 1-301268 | * | 12/1989 | (JP) . | |
| 2-310063 | * | 12/1990 | (JP) | 400/29 |

OTHER PUBLICATIONS

R.A. Haus, IBM Technical Disclosure Bulletin, High Yield and Low Cost Ribbon Feed, vol. 21, 1979.

IBM Technical Disclosure Bulletin, Ribbon–Saving Technique for APA Printers, vol. 31, No. 10, Mar. 1989.

English translation of Japanese patent 1–301268, Tamura et al., Thermal Transfer Recording Device, Dec. 1989.

* cited by examiner

*Primary Examiner*—John S. Hilten
*Assistant Examiner*—Daniel J. Colilla
(74) *Attorney, Agent, or Firm*—Fish & Richardson P.C.

(57) ABSTRACT

A method of printing utilizing a printing apparatus with a print head that has a plurality of printing elements. During the printing process there is relative movement between the print head and the substrate being printed on. In addition, there is relative movement between the print head and the ink ribbon. In one embodiment the ink ribbon is moved in the same direction as the print head relative to the substrate, but a lesser velocity than the print head.

12 Claims, 1 Drawing Sheet

Figure 1:
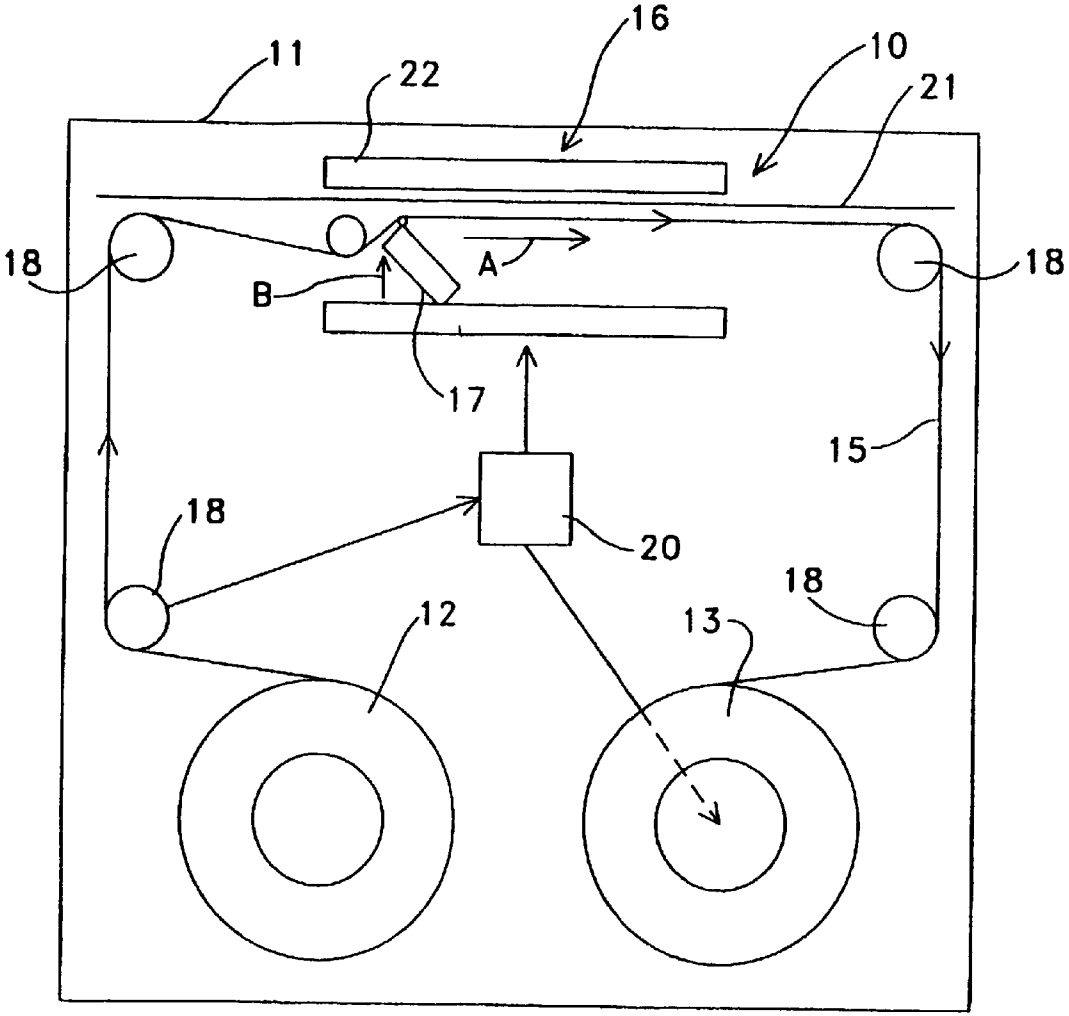

METHOD OF PRINTING IN WHICH THE PRINT HEAD AND PRINT RIBBON MOVE SIMULTANEOUSLY IN THE SAME DIRECTION

This is the national stage of International Patent Application No. PCT/GB97/00738, with an International Filing Date of Mar. 18, 1997, now pending.

This invention related to a method of printing.

So called flat bed thermal printers are known which comprise a printing station at which, during printing, a substrate is held stationary whilst a print head is traversed over the substrate. The print head comprises a plurality of individually energisable printing elements each of which may be energised during printing thus to transfer a pixel of print medium from a carrier onto an adjacent substrate.

Hithertofore during printing, the carrier has been maintained stationary relative to the substrate. After printing, the carrier is advanced and fresh substrate is presented at the printing station. The amount of carrier used thus corresponds closely to the length of image printed. Carrier is an expensive consumable and various methods have been devised for saving carrier, such as described in our previous patent number GB2289441.

The present invention represents an alternative approach.

According to a first aspect of the invention we provide a method of printing utilising a printing apparatus of the kind in which a print head has a plurality of printing elements each of which may be operated during printing, to transfer a pixel of print medium from a carrier onto an adjacent substrate, the method comprising the steps of carrying out printing at a printing station by causing relative movement between the print head and the substrate whilst selectively energising individual printing elements of the print head and, during printing, effecting relative movement between the carrier and each of the print head and the substrate.

Utilising the method of the invention, by virtue of moving the carrier during printing the amount of carrier used during each printing operation is reduced as the amount of carrier used can be arranged to be less than the length of image printed.

The invention is particularly applicable to a printing apparatus which comprises a base and during printing the substrate is maintained stationary relative to the base. However the invention may be applied to a printing apparatus of the kind in which both the carrier and substrate move relative to the base during printing.

Normally, during printing, the carrier will be moved relative to the substrate in the same direction of movement as the relative direction of movement of the print head, but at a lesser velocity.

The printing apparatus may comprise a carrier storage spool and a used carrier take-up spool and the method may include causing movement of the carrier during the printing operation by rotating the carrier take-up spool.

During printing, movement of the carrier may be monitored by a carrier movement sensing means so that the carrier may be moved relative to the substrate a predetermined amount irrespective of the diameter of the take-up spool. One suitable arrangement for sensing carrier movement is the subject of our co-pending patent application number GB9505216.3

The method of the invention may be carried out under the control of a control means, such as a microprocessor control means which may control other functions of the printing apparatus to which the method of the invention is applied.

For example, the control means may control the apparatus such that during a printing operation, prior to performing printing on the substrate, the print head may be moved towards the substrate, and subsequent to performing printing the print head may be moved away from the substrate and returned to a start position so that further printing operations may be carried out, and during the return movement of the print head fresh substrate may be presented at the printing station ready for a further printing operation.

Where the printing apparatus is adapted to perform a plurality of printing operations consecutively and during each printing operation the image which is printed is of substantially the same image length, during the return movement of the print head to the start position the carrier may be held generally stationary.

According to a second aspect of the invention we provide a printing apparatus for performing the method of the first aspect of the invention comprising a print head which has a plurality of printing elements each of which is selectively operable during printing to transfer a pixel of print medium from a carrier onto an adjacent substrate, and means to cause relative movement between the print bead and the substrate during printing whilst selectively operating individual printing elements of the print head characterised in that means are provided to effect relative movement between the carrier and each of the print head and the substrate during printing.

The invention will now be described with reference to the accompanying drawing which is a purely illustrative view of a printing apparatus for performing the method of the invention.

Referring to the drawing there is shown a printing apparatus 10 comprising a base 11 on which is mounted a carrier or ribbon storage spool 12 and a carrier or ribbon take-up spool 13. Ribbon 15 extends along a ribbon path through a printing station 16 where a print head 17 is located, around a plurality of guide rollers 18.

The ribbon take-up spool 13 is driven by a suitable motive means such as stepper motor, under the control of a control means 20, comprising in this example a computer.

The print mead 17 is of the kind comprising an array of selectively energisable printing elements which when energised are heated to transfer pixels of print medium from the ribbon 15 onto a substrate 21. The print head 17 is, during printing traversed over the substrate 21 in the direction indicated by arrow A in the drawing. In this embodiment the substrate 21 is arranged to be stationary at the printing station 16 during printing, and fresh substrate 21 is presented at the printing station 16 between printing, as hereinafter described.

At the printing station 16 there is a platen 22 against which the substrate 21 is urged during printing, by the print head 17, with the ribbon 15 sandwiched between the print head 17 and the platen 22. The apparatus illustrated is known as a flat bed printer. It will be appreciated though that in place of the platen 22, another backing member may be provided, such as for example only, a backing roller which traverses the substrate in synchronism with the print head 17 during printing.

A printing operation will now be described.

With the parts of the apparatus 10 in the positions indicated in the drawing, first the print head 17 is moved by the control means 20 in the direction of arrow B towards and into contact with the ribbon 15. This movement will move the ribbon 15 towards the platen 22 and sandwich the substrate 21 between the ribbon 15 and platen 22. Next the print head 17 is traversed in the direction of arrow A over the substrate 21 whilst the control means 20 selectively energises the printing elements of the print head 17 to remove pixels of ink or other marking medium from the ribbon 15 and deposit them on the substrate thus to print the image.

At the same time the ribbon 15 is advanced through the printing station 16 by means of the take-up spool 13 being driven. Thus there is relative movement at the printing station 16 not only between the print head 17 and ribbon 15, but also between the ribbon 15 and each of the print head 17 and the substrate 21.

The ribbon 15 is of the so called, single strike kind which, a single pixel of ink or other marking medium may be removed from a particular pixel position of the ribbon 15. Hence in order to effect a printing method in accordance with the present invention, the ribbon 15 needs to be moved through the printing station 16 at a different velocity that the print head 17 traverses the substrate 22.

Preferably the ribbon 15 is moved through the printing station 16 during printing at a velocity of about half the velocity at which the print head 17 traverses the substrate 21 so that about half the ribbon 15 is consumed compared to a conventional arrangement in which the ribbon 15 is maintained stationary at the printing station 16 during printing and advanced after printing, an amount generally equal to the length of image printed during immediately preceding printing.

It will be appreciated that in the embodiment described in which movement of the ribbon 15 is effected by rotating the take-up spool 13, some means is required to compensate for the growing diameter of the ribbon 15 on the take-up spool 13, to ensure a predetermined and generally constant amount of ribbon advance in each printing operation.

In our previous patent application published under number WO 96/28304 there is disclosed the use of a sensing means comprising one of the idler rollers 18, which provides an input to the control means 20 dependent upon the amount of ribbon advanced, so that the number of steps stepped by the stepper motor driving spool 13 to move the ribbon 15 during printing, reduces commensurately with the growing diameter of the ribbon 15 on the take-up spool 13. However any other suitable arrangement could be employed, or the ribbon 15 may be driven by a capstan type drive, or otherwise in a way in which the amount of ribbon 15 moved is independent of the growing diameter of ribbon on the takeup spool 13.

After printing, the control means 20 is arranged to cause movement of the print head 17 away from the platen 22 in a direction opposite to the direction of arrow B, and to return the print head 17 to a start position shown in the drawing, ready for the next printing operation.

Also, as the print head 17 returns to its start position, ordinarily the ribbon 15 is maintained stationary, but fresh substrate, by which we mean an entirely new substrate such as a new label or other article to be printed upon, or a new area of a continuous substrate, is presented at the printing station 16, ready for the next printing operation.

Thus there is no need to advance the ribbon 15 during printing operations where the printing apparatus 10 is adapted to perform a plurality of printing operations consecutively and during each printing operation the image which is printed is of substantially the same image length. However where the image lengths vary, particularly if the image length of a subsequent image to be printed is shorter than that of the previously printed image, during return of the print head 17 to the start position, the ribbon 15 may be arranged partially to be rewound to avoid wastage. This may be achieved by arranging to drive the ribbon storage spool 12 in a direction opposite to the direction the ribbon take up spool 13 is wound during printing.

Where the image length of a subsequent image to be printed is greater than that of the previously printed image, during return of the print head 17 to the start position, the ribbon 15 may be advanced slightly to ensure that only fresh ribbon 15 is used for printing in the subsequent printing operation.

It will be appreciated that in a thermal transfer printer of the kind described, selected printing elements are energised in a plurality of discrete printing positions as the print head 17 is traversed over the substrate 21 in order to build up the image line by line. In a conventional arrangement in which the ribbon 15 is maintained stationary relative to the substrate during printing, ribbon between the discrete printing positions is unused. In the method of the invention, by virtue of the ribbon moving relative to both the print head 17 and substrate 21 during printing at least some of that otherwise unused ribbon is utilised.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

I claim:

1. A method of printing utilizing a printing apparatus of the kind in which a print head has a plurality of printing elements each of which may be operated during printing to transfer a pixel of print medium from a carrier onto an adjacent substrate, the method comprising the steps of carrying out printing at a printing station by causing relative movement between the print head and the substrate while selectively operating individual printing elements of the print head and during printing, relative movement is effected between the carrier and each of the print head and the substrate, including movement of both the carrier and the print head relative to each other, such that the carrier feed motion and print head motion are simultaneously in the same direction.

2. A method according to claim 1 wherein the printing apparatus comprises a base and during printing the substrate is maintained stationary relative to the base.

3. A method according to claim 1 wherein during printing the carrier is moved relative to the substrate in the same direction of movement as the relative direction of movement of the print head, but at a lesser velocity.

4. A method according to claim 1 wherein the printing apparatus comprises a carrier storage spool and a used carrier take-up spool and the method includes causing movement of the carrier during printing by rotating the carrier take-up spool.

5. A method according to claim 4 wherein during printing, movement of the carrier is monitored by a carrier movement sensing means so that the carrier may be moved relative to the substrate at least during subsequent printing operations, a predetermined amount irrespective of the diameter of the take-up spool.

6. A method according to claim 1 wherein the method is carried out under the control of a control means.

7. A method according to claim 1 wherein prior to performing printing, the print head is moved towards the substrate, and subsequent to performing printing the print head is moved away from the substrate and returned to a start position so that further printing operations may be carried out, and during the return movement of the print head fresh substrate is presented at the printing station ready for a further printing operation.

8. A method according to claim 7 wherein the printing apparatus is adapted to perform a plurality of printing operations consecutively and during each printing operation the image which is printed is of substantially the same image length, and during the return movement of the print head to the start position the carrier is held generally stationary.

9. The method of claim 1 wherein the printing apparatus is a flat bed printer.

10. A printing apparatus comprising a print head which has a plurality of printing elements each of which is selectively operable during printing to transfer a pixel of print medium from a carrier onto an adjacent substrate, said apparatus being constructed to cause relative movement between the print head and the substrate during printing while selectively operating individual printing elements of the print head to effect relative movement between the carrier and each of the print head and the substrate during printing including movement of both the carrier and the print head relative to each other, such that the carrier feed motion and print head motion are simultaneously in the same direction.

11. The apparatus of claim 10 wherein the printing apparatus is a flat bed printing.

12. A method of printing utilizing a printing apparatus of the kind in which a print head has a plurality of printing elements each of which may be operated during printing to transfer a pixel of print medium from a carrier onto an adjacent substrate, said printing apparatus including a base relative to which the print head and carrier move during printing while the substrate is stationary relative to the base, the method comprising the steps of carrying out printing at a printing station by causing relative movement between the print head and the substrate while selectively operating individual printing elements of the print head in that during printing, relative movement is effected between the carrier and each of the print head and the substrate, such that the carrier feed motion and print head motion are simultaneously in the same direction.

* * * * *